US007875152B2

(12) United States Patent
Rodriguez

(10) Patent No.: US 7,875,152 B2
(45) Date of Patent: Jan. 25, 2011

(54) TORN PAPER WEB CAPTURE SYSTEM

(76) Inventor: Peter A. Rodriguez, 1545 Main St., Atlantic Beach, FL (US) 32233

( * ) Notice: Subject to any disclaimer, the term of this patent is extended or adjusted under 35 U.S.C. 154(b) by 452 days.

(21) Appl. No.: 12/214,605

(22) Filed: Jun. 20, 2008

(65) Prior Publication Data

US 2008/0314542 A1 Dec. 25, 2008

Related U.S. Application Data

(60) Provisional application No. 60/936,709, filed on Jun. 21, 2007.

(51) Int. Cl.
*D21F 7/06* (2006.01)
*B23Q 15/00* (2006.01)

(52) U.S. Cl. ..... 162/263; 101/219; 101/228; 242/422.5; 242/422.6; 242/422.7; 242/538; 242/580; 226/11

(58) Field of Classification Search ..... 162/263; 101/219; 226/11; 242/422.5, 422.6, 422.7, 242/538, 563, 580, 526.2
See application file for complete search history.

(56) References Cited

U.S. PATENT DOCUMENTS 2,461,246 A * 2/1949 Weyenberg ..... 242/526.2
4,549,485 A 10/1985 Nawrath
4,711,404 A * 12/1987 Falk ..... 242/526.2
4,846,060 A 7/1989 Proctor
5,036,765 A 8/1991 Keilhau
5,163,371 A 11/1992 Kotterer et al.
5,417,383 A * 5/1995 Rodriguez et al. ..... 242/526.2
5,725,177 A * 3/1998 Bartelmuss et al. ..... 242/526.2
5,816,526 A * 10/1998 Bartelmuss et al. ..... 242/526.2
5,931,092 A 8/1999 Werner et al.
6,058,836 A 5/2000 Kusunoki
7,044,417 B2 * 5/2006 Angold et al. ..... 242/474.4

FOREIGN PATENT DOCUMENTS

DE 10195714 T 4/2003

* cited by examiner

*Primary Examiner*—Matthew J Daniels
*Assistant Examiner*—Jacob Thomas Minskey
(74) *Attorney, Agent, or Firm*—Thomas C. Saitta

(57) ABSTRACT

A torn paper web capture system that is a mechanism for securing a band, tape or strap, preferably composed of paper, across a paper roll as the roll is rotating. A sensor means detects the torn paper web and initiates both the shut down of rotation of the paper roll and the release of the band. The band resides within a guide track, the track being generally C-shaped in cross-section Upon contact with spool journal or similar rotating member the end of the band adheres and is wrapped around the rotating member. This wrapping action takes up the slack in the band and pulls it from the guide track and against the paper web, thereby securing the loose end of the paper web. The contact between the band and the rotating member may be initiated in multiple ways, such as with a nip roller, an actuating shoe member, or the like.

13 Claims, 4 Drawing Sheets

TORN PAPER WEB CAPTURE SYSTEM

This patent application claims the benefit of U.S. Provisional Patent Application Ser. No. 60/936,709, filed Jun. 21, 2007.

BACKGROUND OF THE INVENTION

This invention relates generally to the field of systems designed to immediately capture or secure a torn paper web unwinding from a spool or roll in a large paper processing apparatus. More particularly, the invention relates to such devices that secure the torn end of the paper web onto the rotating paper roll.

In paper processing systems, such as in paper manufacturing, treating, printing or the like, large rolls or spools of paper weighing many thousands of pounds are used to deliver the paper web into the processing system. These spools may be ten, twenty or more feet in width, and unwind at high speeds. Often, a break occurs in the paper web during the unwinding process. Because the rolls are unwinding at high speed, hundreds of feet of paper weighing hundreds of pounds may unwind in an uncontrolled manner prior to shut down of the paper roll feeding mechanism. This uncontrolled paper discharge may damage or foul the equipment, and extensive time and effort is required to remove and dispose of the waste.

A number of systems have been developed to address this problem. Examples are shown in U.S. Pat. No. 4,549,485 to Nawrath, U.S. Pat. No. 5,036,765 to Keilhau, U.S. Pat. No. 5,163,371 to Kotterer et al., U.S. Pat. No. 5,931,092 to Werner et al., and German Published Application DE 10195714T TO Heikki.

It is an object of this invention to provide a torn paper web capture system that quickly secures the loose end of the paper web to the rotating spool that is patentably distinct and/or an improvement over the known systems.

SUMMARY OF THE INVENTION

The torn paper web capture system comprises in general a mechanism for securing a band, tape or strap, preferably composed of paper, across a paper roll as the roll is rotating. A sensor means detects the torn paper web and initiates both the shut down of rotation of the paper roll and the release of the securing band. Prior to actuation, the band resides within a guide track that extends across the width of the paper web, the track being generally C-shaped in cross-section or of alternative configuration such that the entire length of band may be pulled or snapped through the longitudinal opening in the track. At least a portion of the band is preferably provided with a pressure sensitive adhesive, such that upon detection of the torn paper web the end of the band is advanced so as to come into contact with a spool journal or similar rotating member, at which time the end of the band adheres and is wrapped around the rotating member. The band being secured at the opposite end, the wrapping action takes up the slack in the band, pulling it from the guide track and tightly across the paper web, thereby securing the loose end of the paper web. The contact between the band and the rotating member may be initiated in multiple ways, such as with a nip roller, an actuating shoe member, or the like.

DETAILED DESCRIPTION OF THE INVENTION

Figure 1:
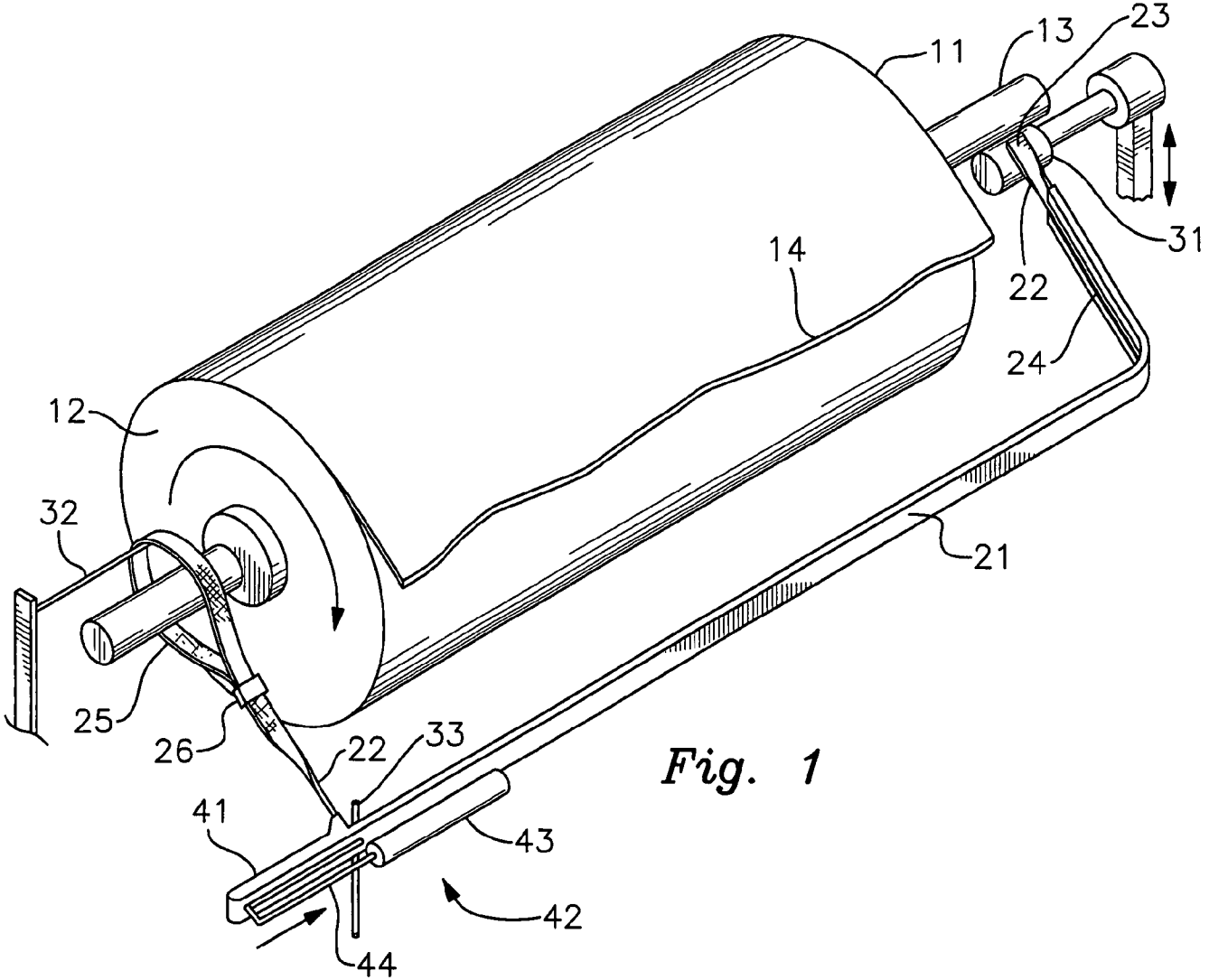
FIG. 1 is a perspective view of an embodiment of the system prior to activation of the capture band, shown here with the embodiment of the contacting means being a nip roller.

With reference to the drawings, the invention will now be described with regard for the best mode and the preferred embodiment. In general, the invention is a torn paper web capture system for restraining or securing the loose torn end of a paper web that is being rapidly unspooled, the system securing a band, tape or strap (hereinafter referred to collectively as a "band") across the rotating paper spool or roll immediately upon detection of a break or tear in the paper web, such that the delay in stoppage of the rotation of the large paper spool does not result in large amounts of paper web being uncontrollably discharged from the spool.

As shown in the drawings, a long paper web 11 which may be hundreds or thousands of feet in length is wound to form spool or roll 12 mounted onto a journal, axle or other rotating member 13. The paper spool 12, after delivery to other locations or being mounting into a particular paper processing system, is rotated at high speed in order to unwind the paper web 11 and deliver it for further processing. Often times the paper web 11 tears or breaks during the unwinding, such that a torn or free end 14 is accidentally created.

A fixed guide track 21 is provided that extends across the full width of the paper spool 12, at a location that does not interfere with the transfer of the paper web 11 from the spool 12. The guide track 21 temporarily retains an elongated band, tape or strap 22, preferably composed of paper and preferably coated on one side, at least near its free end 23, with a pressure sensitive adhesive. In a preferred embodiment, he guide track 21 is generally C-shaped in cross-section, such that an elongated open slot 24 is presented toward the paper spool 12. Other configurations creating the elongated open slot 24 are also possible for the guide track 21. The slot 24 provides an avenue through which the band 22 is snapped or pulled to remove it from the track 21. The track 21 may be located above or below the unwinding paper web 11. Sensing means of any known type known in the industry to be suitable for the purpose are provided to detect a tear or break in the paper web 11, the sensing means serving to stop rotation of the paper spool 12 as quickly as possible upon detection of the break, as well as serving to initiate capture of the free end 14 of the paper web 11. Upon detection of a break, band release means are activated, such that the band 22 is immediately pulled from the guide track 21 and stretched tautly across the paper spool 12 from one end of the spool 12 to the other.

Figure 2:
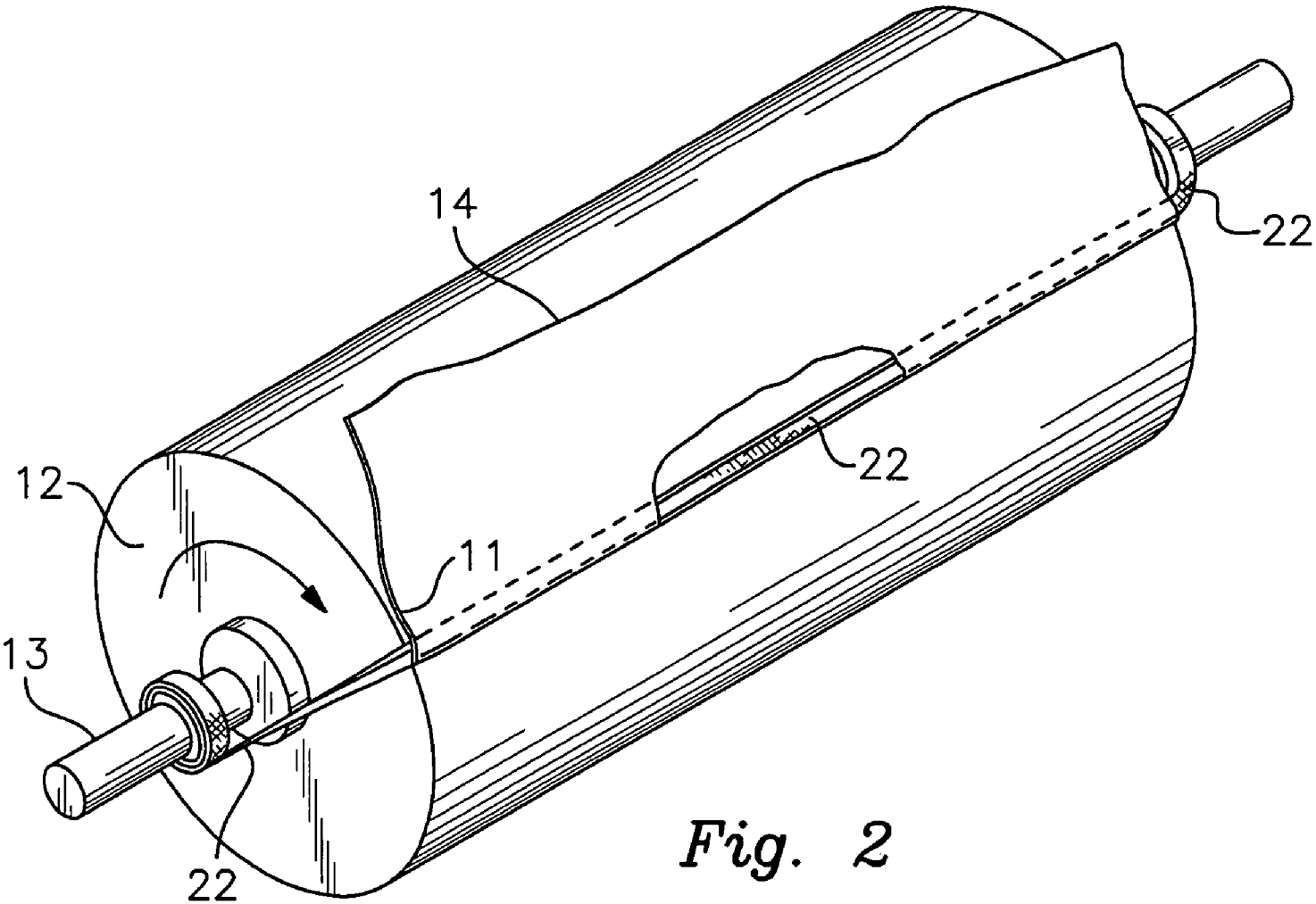
FIG. 2 is a perspective view of the embodiment of FIG. 1 illustrating the band securing the torn end of the paper web after activation.

The means for releasing the band 22 illustrated in FIGS. 1 and 2 comprises a nip roller 31 disposed adjacent the rotating member 13, such that the free end 23 of the band 22 may be inserted and received therebetween. Upon insertion, the pressure sensitive adhesive adheres the band 22 to the rotating member 13, such that the band 22 begins to wind about the rotating the member 13. The nip roller 31 is mounted so as to allow for reciprocating movement relative to the rotating member 13, either in a controlled or spring-biased manner, such that the band 22 is able to make multiple rotations about the rotating member 13. As the band 22 winds about the rotating member 13, it begins to release through the elongated slot 24 in the guide track 21. In the embodiment shown in FIG. 1, the opposite end of the band 22 is formed as a slip loop 25 using a sliding buckle 26 or like design. As the band 22 is drawn across the paper spool 12, the buckle 26 slides to tighten the loop 25 about the rotating member 13, thereby securing the band 22 tightly across the paper spool 12 from both ends, as shown in FIG. 2. A torsion or spring-mounted rod 32 may be used to maintain the slip loop 25 in a non-contacting position until release of the band 22 is initiated. With the band 22 drawn tautly across the paper spool 12, the free end 14 of the paper web 11 is restrained, such that continued revolutions of the paper spool 12 prior to stoppage does not discharge the paper web 11.

In one embodiment, the guide track 21 is provided with a tape feeding means comprising a double band receptacle 41 sized to receive a folded section of band 22 and a band feeding mechanism 42, shown in FIG. 1 to comprise a cylinder 43 operated pneumatically, hydraulically or the like and a reciprocating arm 44. Another torsion rod 33 or the like is provided to retain the band 22 within the guide track 21. Upon actuation, the band feeding mechanism 42 advances the band 22 linearly through the guide track 21 such that the free end 23 of the band 22 is inserted between the nip roller 31 and the rotating member 13. In this embodiment, a relatively stiff band 22 must be provided such that linear movement of the band 22 within the guide track 21 is readily accomplished.

Figure 3:
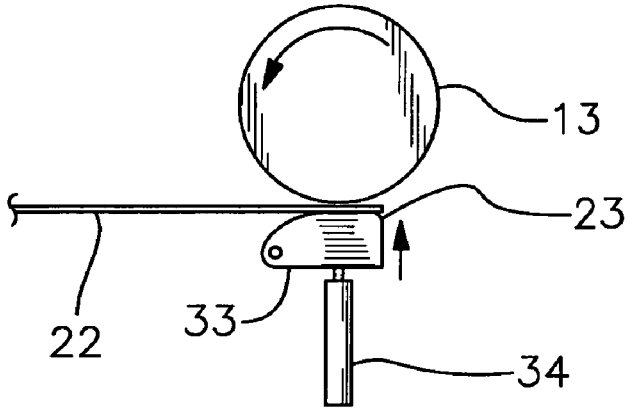
FIG. 3 is a view of an alternative embodiment of the contacting means, shown here as an actuating shoe member.

In an alternative embodiment for the band release means shown in FIG. 3, the nip roller 31 is replaced with an actuating shoe member 33 operated by a shoe cylinder 34, the free end 23 of the band 22 being disposed between the shoe member 33 and the rotating member 13. Upon detection of a break in the paper web 11, the cylinder advances the shoe member 33 against the rotating member 13, such that the band 22 is would around the rotating member 13 and pulled from the guide track 21, as previously described to tighten the band 22 across the paper spool 12 as it rotates prior to stopping. Alternative embodiments are also contemplated such that both ends of the band 22 could be contacted to the rotating member 13 by a pair of nip rollers 31 or a pair of shoe members 33.

Figure 5:
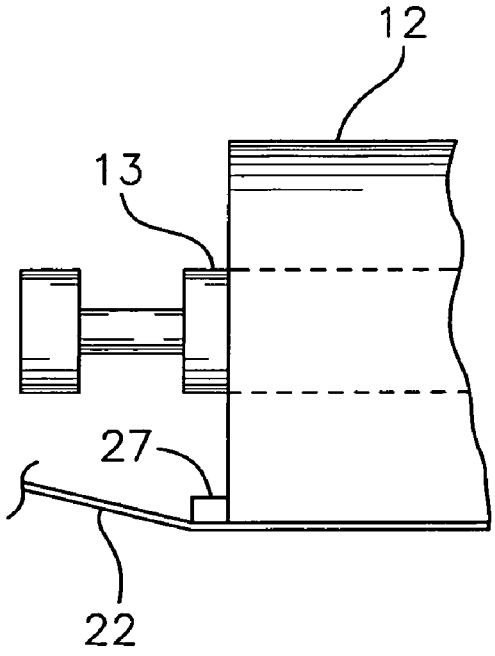
FIG. 5 is a partial view of the embodiment of FIG. 4 showing the brake member caught against the edge of the paper roll after activation.
Figure 4:
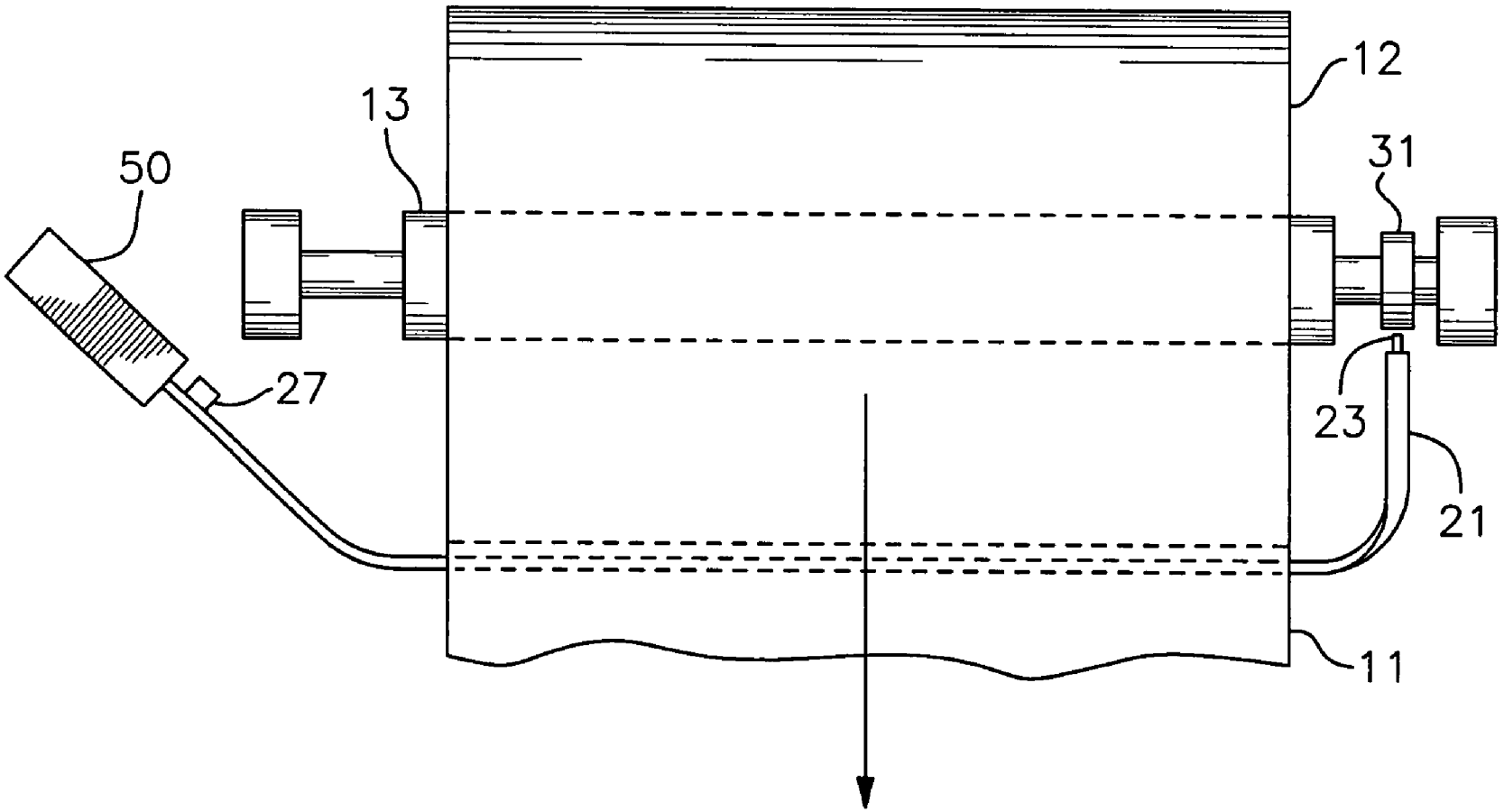
FIG. 4 is a view of an alternative embodiment of the system prior to activation of the capture band, wherein a brake member is mounted on the capture band.

In a further embodiment illustrated in FIGS. 4 and 5, a simpler version of the invention is presented. In this embodiment, a brake or anchor member 27 is attached to the capture band 22, the band 22 extending from a dispenser or retention mechanism 50. The brake member 27 is structured so as to snag or catch on the end of the paper spool 12 once the band release means is activated and the band 22 is pulled across the spool 12, as shown in FIG. 5, thereby securing the band 22 tightly across the spool 12 to retain the torn free end 14. The band brake member 27 should be located within the minimum radius of the paper spool 12, preferably at approximately a 45 degree angle, such that the torn free end 14 will be captured no matter how little paper web 11 remains on the spool 12 at the time of failure.

It is contemplated that equivalents or substitutions for elements set forth above may be obvious to those of ordinary skill in the art, and therefore the true scope and definition of the invention is to be as set forth in the following claims.

I claim:

1. A torn paper web capture system securing upon detection the torn free end of a paper web unwinding from a paper spool mounted on a rotating member, said system comprising:

a capture band releasably retained within a guide track, said guide track and said capture band extending across said paper spool, said capture band comprising a free end and a secured end;

means for releasing said band from said guide track, wherein said band release means further comprises a nip roller cooperating with said rotating member to advance said free end of said capture band or said band release means further comprises a shoe member operated by a cylinder and cooperating with said rotating member to advance said free end of said capture band;

whereby upon activation said free end of said band is secured to said rotating member and rotation of said rotating member pulls said capture band from said guide track such that said capture band is drawn across said paper spool to secure said free end of said paper web.

2. The system of claim 1, wherein said guide track comprises an elongated slot through which said capture band is released.

3. The system of claim 1, said capture band comprising a looped end disposed about said rotating member.

4. The system of claim 3, said capture band further comprising a sliding buckle.

5. The system of claim 1, further comprising means for feeding said band through said guide track comprising a double band receptacle and a band feeding mechanism.

6. The system of claim 5, said band feeding mechanism comprising an arm advanced by a cylinder.

7. The system of claim 1, further comprising a brake member mounted on said capture band, whereby said brake member catches on said paper spool when said paper band is drawn across said paper spool.

8. The system of claim 7, wherein said brake member is located within the minimum radius of said paper spool.

9. The system of claim 7, wherein said guide track comprises an elongated slot through which said capture band is released.

10. A torn paper web capture system securing upon detection the torn free end of a paper web unwinding from a paper spool mounted on a rotating member, said system comprising:

a paper capture band releasably retained within a guide track, said guide track and said capture band extending across said paper spool, said capture band comprising an adhesive-coated free end and a brake member mounted on said capture band, and wherein said guide track comprises an elongated slot through which said capture band is released;

means for releasing said band from said guide track, whereby upon activation said free end of said band is secured to said rotating member and rotation of said rotating member pulls said capture band from said guide track such that said capture band is drawn across said paper spool and said brake member catches on said paper spool to secure said free end of said paper web.

11. The system of claim 10, wherein said band release means further comprises a nip roller cooperating with said rotating member to advance said free end of said capture band.

12. The system of claim 10, wherein said band release means further comprises a shoe member operated by a cylinder and cooperating with said rotating member to advance said free end of said capture band.

13. The system of claim 12, wherein said brake member is located within the minimum radius of said paper spool.

* * * * *